US009089031B2

(12) United States Patent
Maa et al.

(10) Patent No.: US 9,089,031 B2
(45) Date of Patent: Jul. 21, 2015

(54) ADD-ON SMART CONTROLLER FOR LED LIGHTING DEVICE

(71) Applicant: Lightel Technologies, Inc., Renton, WA (US)

(72) Inventors: Chia-Yiu Maa, Bellevue, WA (US); Ching-Feng Lin, Taipei (TW); Chun-Te Yu, Bellevue, WA (US); Pai-Sheng Shen, Bellevue, WA (US)

(73) Assignee: Lightel Technologies, Inc., Renton, WA (US)

( * ) Notice: Subject to any disclaimer, the term of this patent is extended or adjusted under 35 U.S.C. 154(b) by 61 days.

(21) Appl. No.: 14/176,313

(22) Filed: Feb. 10, 2014

(65) Prior Publication Data

US 2015/0108900 A1 Apr. 23, 2015

(51) Int. Cl.
*H05B 37/02* (2006.01)
*H05B 33/08* (2006.01)

(52) U.S. Cl.
CPC ..... *H05B 33/0842* (2013.01)

(58) Field of Classification Search
CPC ..... H05B 33/0842; H05B 33/0854; H05B 37/0218; H05B 37/0227; Y02B 20/46
USPC ..... 315/307, 291, 149, 58, 61; 250/214 AL; 340/541
See application file for complete search history.

(56) References Cited

U.S. PATENT DOCUMENTS 8,143,567 B2 * 3/2012 Williams et al. ..... 250/214 AL
8,994,276 B2 * 3/2015 Recker et al. ..... 315/160

* cited by examiner

*Primary Examiner* — Haissa Philogene
(74) *Attorney, Agent, or Firm* — Han IP Corporation

(57) ABSTRACT

An add-on smart controller for an LED lighting device includes a power input port, a power output port, a housing, a control unit in the housing, and at least one control signal receiver in the control unit. A power input of the control unit is connected to the power input port. A power output of the control unit is connected to the power output port. The control signal receiver is configured to receive external control signals. The control unit is configured to activate the power output port to supply output voltage responsive to the control unit receiving an ON signal. The control unit is configured to deactivate the power output port responsive to the control unit receiving an OFF signal.

21 Claims, 6 Drawing Sheets

ADD-ON SMART CONTROLLER FOR LED LIGHTING DEVICE

CROSS REFERENCE TO RELATED PATENT APPLICATION

The present disclosure claims the priority benefit of Chinese Patent Applications No. 201310495315.3, filed on Oct. 22, 2013, and No. 201310703622.6, filed on Dec. 20, 2013, with the State Intellectual Property Office of China.

BACKGROUND

1. Technical Field

The present disclosure pertains to the field of lighting devices and, more specifically, proposes an add-on smart controller for a light-emitting diode (LED) lighting device.

2. Description of Related Art

A longer lifetime is one of the most distinguishing features of LED lighting devices. However, most of the LED lighting devices in use today do not offer significant control functionality, and the newer LED lighting devices that do have control features that are built-in, making it impossible to change or upgrade the control functionality of these LED lighting devices. Thus, the only option to increase control functionality is to replace the entire lighting device. This is a very costly option, given that oftentimes the LED lighting devices themselves still have a long remaining lifetime. A more cost-effective solution, then, would be to increase the control functionality of the existing LED lighting device without replacing it. Examples would include using an add-on dimmer to give a non-dimmable lighting device a dimming function, employing an add-on remote controller to give a non-remote-controllable lighting device a remote control function, and using an add-on day-light-harvest controller to give a regular lighting device a day-light-harvest function (producing light output inverse proportional to the ambient day light). This present disclosure provides various embodiments of such an add-on smart controller for lighting devices.

SUMMARY

In one aspect, an add-on smart controller for an LED lighting device may include: a power input port, a power output port, a housing, a control unit in the housing, and at least one control signal receiver in the control unit. A power input of the control unit may be connected to the power input port. A power output of the control unit may be connected to the power output port. The control signal receiver may be configured to receive external control signals. The control unit may be configured to activate the power output port to supply output voltage responsive to the control unit receiving an ON signal. The control unit may be configured to deactivate the power output port responsive to the control unit receiving an OFF signal.

In some embodiments, the control unit may include a dimmer configured to control the output voltage or current flowing through the power output port according to the control signal.

In some embodiments, the dimmer may be a voltage-based step-dimmer and configured to control the output voltage of the power output port according to the control signal.

In some embodiments, the voltage-based step-dimmer may include a control signal input port, a controllable switcher, and a transformer. The control signal input port may be connected to the controllable switcher. An output of the controllable switcher may be connected to an input of the transformer. An output of the transformer may be connected to the power output port.

In some embodiments, the voltage-based step-dimmer may be configured to supply power at a voltage level same as an external input power, at a voltage level lower than the external input power, or at zero voltage.

In some embodiments, the dimmer may be a voltage-based linear dimmer comprising a control signal input port, a step-motor, and an autotransformer. The control input signal may be connected to and configured to control the step-motor. The step-motor may be configured to control an input level of the autotransformer and cause an output level of the autotransformer to change in a linear fashion.

In some embodiments, the dimmer may be a current-based linear dimmer configured to control the effective operation cycle of an AC input current wave from 360 degrees down to 0 degree in a linear or step-wise fashion according to the control signal.

In some embodiments, the control signal receiver may be configured to receive control signals through infra-red signals, WiFi signals, Bluetooth signals, power-line-transmitted signals, a control signal line, or a combination thereof.

In some embodiments, the control signal receiver may include an Internet network interface configured to receive control signals according to IP protocol.

In some embodiments, the control unit may include a motion sensor configured to activate the power output port using motion detection.

In some embodiments, the control unit may include a sound sensor configured to activate the power output port using sound detection.

In some embodiments, the control unit may include a color tuning module configured to adjust a color temperature of the LED lighting device.

In some embodiments, the control unit may include an ambient light sensor configured to control the dimmer automatically according to an ambient light level.

In some embodiments, the control unit may include a rectifier configured to convert an AC input current to a DC output current.

In some embodiments, the controller may include a connecting mechanism that attaches the controller directly onto the LED lighting device.

In some embodiments, the connecting mechanism, disposed between the controller and the LED lighting device, may include the power output port having a form of any screw-in shaped socket, hole-shaped socket, or any existing standard electrical socket.

In some embodiments, the power input port may have a form of any screw-in shaped connector, pin-shaped connector, or any existing standard electrical connector.

In some embodiments, a shape of the power input port may match a shape of the power output port.

In some embodiments, a shape of the power input port may not match a shape of the power output port.

In some embodiments, the housing may include a concavity to house the socket of the power output port.

In some embodiments, the control unit may include an ambient light sensor configured to control the dimmer automatically according to an ambient light level.

The claims and advantages will be more readily appreciated as the same becomes better understood by reference to the following detailed description and the accompanying drawings showing exemplary embodiments, in which like reference symbols designate like parts. For clarity, various parts of the embodiments in the drawings are not drawn to scale.

BRIEF DESCRIPTION OF THE DRAWINGS

The accompanying drawings are included to aid further understanding of the present disclosure, and are incorporated in and constitute a part of the present disclosure. The drawings illustrate a select number of embodiments of the present disclosure and, together with the detailed description below, serve to explain the principles of the present disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED EMBODIMENTS

Overview

Various implementations of the present disclosure and related inventive concepts are described below. It should be acknowledged, however, that the present disclosure is not limited to any particular manner of implementation, and that the various embodiments discussed explicitly herein are primarily for purposes of illustration. For example, the various concepts discussed herein may be suitably implemented in a variety of LED lighting devices having different form factors.

The present disclosure discloses an add-on smart controller for the LED lighting device that allows for new functionality to be added to the lighting device without entirely replacing the LED lighting device. For example, the existing LED lighting device may not have dimming capability. By using an add-on smart controller with dimming capability, the LED lighting device would become dimmable without any modification to the rest of the LED lighting device. Similarly, an add-on smart controller with an ambient light sensor would allow for automatic light adjustment of the LED lighting device without any modification to the LED lighting device. Alternatively, using an add-on smart controller with a remote control function would allow the LED lighting device to become remote-controllable.

Separately, a new add-on smart controller may be used to upgrade existing functionality. For example, an older control module with a motion sensor that only has a detection range of 2 meters could be upgraded to a new control module with a better motion sensor that increases the detection range to 10 meters. In the same way, an older control module that uses an infra-red remote control that is limited to distances of up to 5 meters and cannot penetrate through a solid object may be replaced with a new control module using WiFi remote control that is effective over distances of up to 20 meters and can penetrate solid objects. Another example would be to use a new control module with a high-performance driver to achieve higher energy efficiency. An end user would be able to enjoy these upgrade functionalities without making any modification to the existing LED lighting device.

Different add-on smart controllers would also allow for product differentiation. For examples, an IR-based plug-and-play control module would be available for users or areas that require IR remote control, while a WiFi-based plug-and-play control module would be available for users or areas that require WiFi-based remote control. In both cases, there is no need to replace the existing LED lighting device, thus maximizing the value of the LED lighting device and increasing its functionality.

Example Implementations

Figure 1:
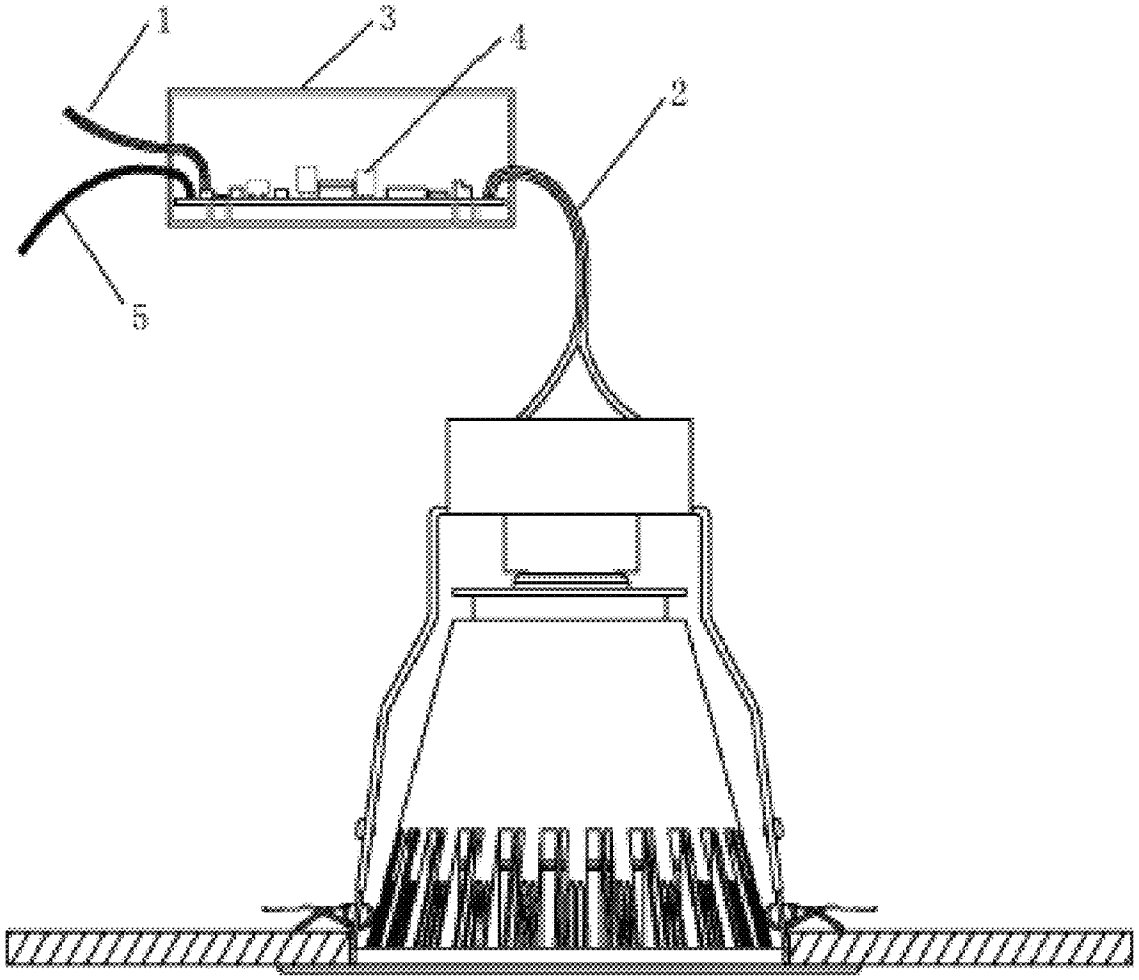
FIG. 1 schematically depicts an embodiment of the present disclosure.
Figure 2:
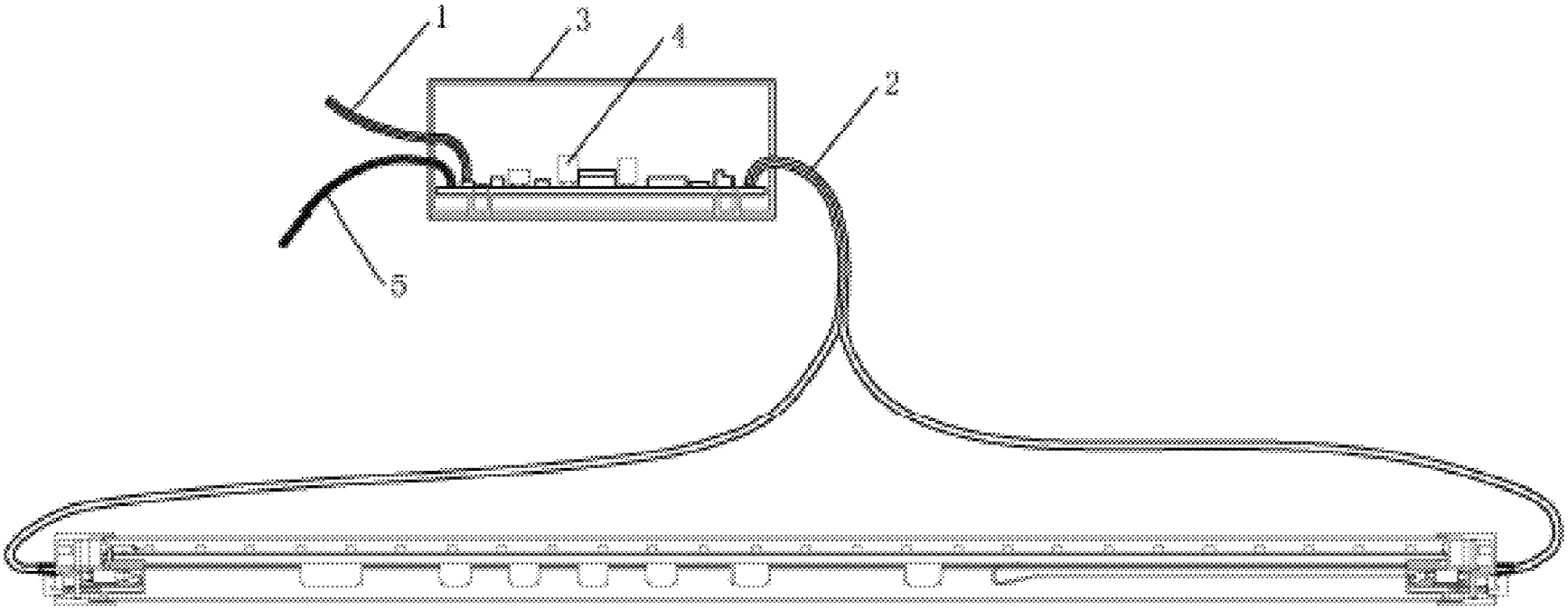
FIG. 2 schematically depicts another embodiment of the present disclosure.

FIGS. 1 and 2 illustrate one non-limiting embodiment of the add-on smart controller of the present disclosure. An add-on smart controller for LED lighting device comprises a power input port 1, a power output port 2, a housing 3, a control unit 4 in the housing 3, and a control signal receiver 5. The power input port 1 connects the external power to the control unit 4. The power output port 2 connects the control unit 4 to the LED lighting device.

When the control signal receiver 5 receives an ON signal, the control unit 4 activates the output power port 2; when the control signal receiver receives an OFF signal, the control unit deactivates the output power port 2. The control signal receiver may be an infra-red receiver, a WiFi receiver, a Bluetooth receiver, a power-line-transmitted signal receiver, or a receiver controlled via a control signal line. The control signal receiver may also incorporate an Internet network interface capable of receiving control signals according to IP protocol.

In other embodiments of the present disclosure, the control signal receiver includes a motion sensor, sound sensor, ambient light sensor, and the combination thereof. Alternatively, the control unit may include a motion sensor, sound sensor, ambient light sensor, or the combination thereof. The motion sensor delivers an ON signal when motion is detected. The sound sensor delivers an ON signal when sound is detected. The ambient light sensor delivers an ON signal when the ambient light level drops below a preset threshold.

Figure 3:
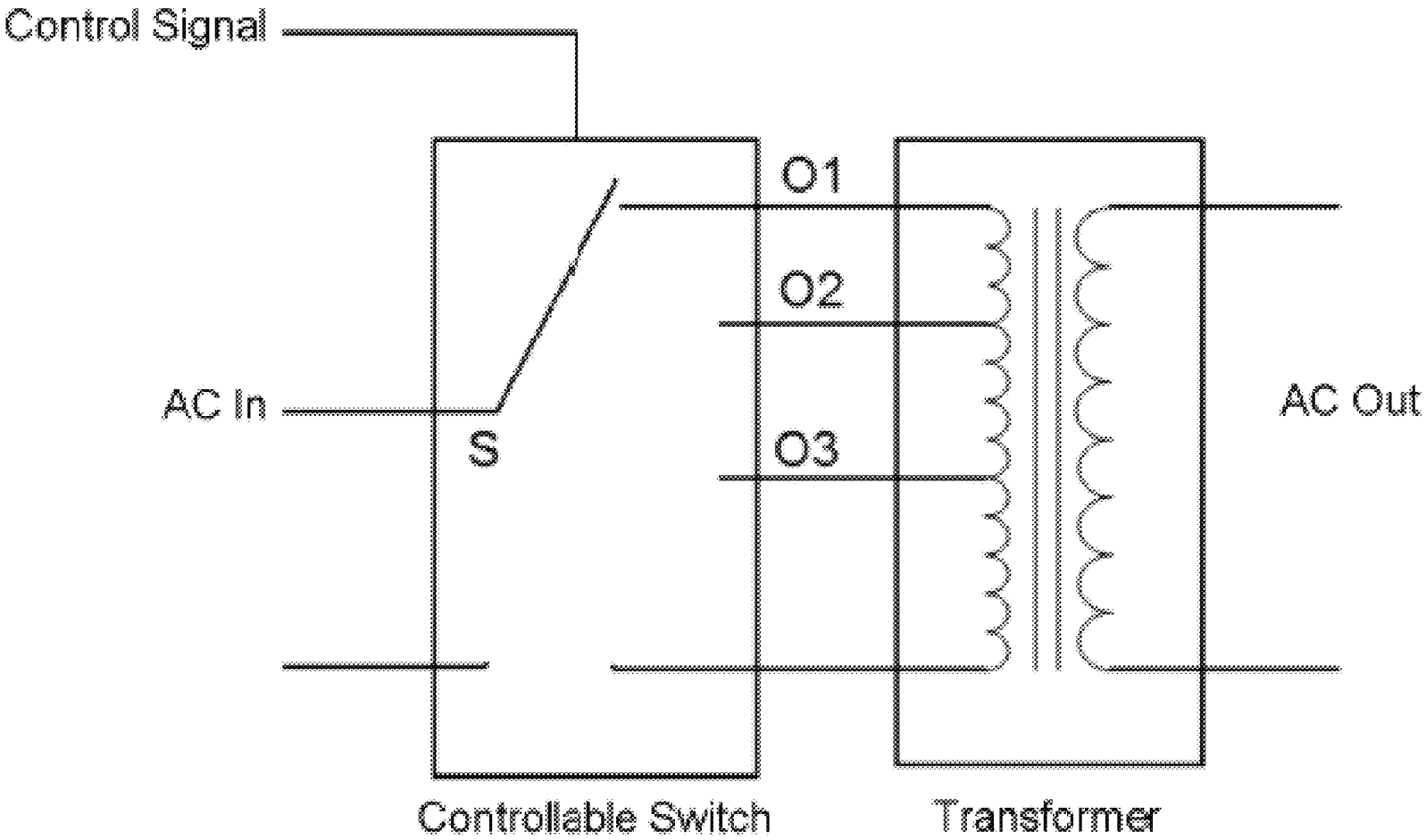
FIG. 3 schematically depicts an embodiment of the voltage-based step-dimmer of the present disclosure.

In other embodiments of the present disclosure, the control unit includes a dimmer for adjusting the output voltage or current level of the power output port. FIG. 3 illustrates a non-limiting embodiment of a voltage-based step dimmer comprising a control signal input port, a controllable switch, and a transfer. The control signal input connects to and controls the controllable switch. The output of the controllable switch connects to the input of the transformer. The output of the transformer connects to the power output port. The voltage-based step dimmer controls the output voltage level of the transformer to equal the input voltage, to be lower than the input voltage, or to zero voltage, according to the received control signal. More specifically, the control signal controls whether the controllable switch connects the switch S to any of the output ports O1, O2, or O3, or connects to none of them, resulting no output voltage. When the control signal activates the output port O1, the output voltage level of the transformer is the same as the AC input voltage. When the control signal activates the output port O2, the output voltage level of the transformer is lower than the AC input voltage. When the control signal activates the output port O3, the output voltage level of the transformer is set still lower than the AC input voltage. When the control signal does not activate any of the output ports, the transformer generates no output voltage.

In another embodiment, a linear voltage-based dimmer that smoothly adjusts the output voltage may comprise a control signal input port, a step motor, and an autotransformer. The control signal connects to and controls the step motor, which in turn controls the input voltage level of the autotransformer and consequently the output voltage level of the transformer.

In another embodiment, a current-based dimmer may be used to adjust the operation cycle of the AC input current wave from 360 degree down to 180 degree, thus reducing the overall power output efficiency to 50%. Similarly, the current-based dimmer may be step-dimming or linear dimming, depending on whether the adjustment of the output current is step-wise or linear.

In other embodiments, an ambient light sensor is inserted between the input power port and the dimmer and enables the dimmer to automatically adjust the output voltage or current level of the power output port according to the ambient light level. The higher the ambient light level, the lower the output level of the power output port. The lower the ambient light level, the higher the output level of the power output port. In other embodiments, the control unit includes a color tuner for adjusting the color temperature of the LED lighting device. The color tuner may also be used together with a dimmer to simultaneously control both the color temperature and the light output level of the LED lighting device.

Figure 4:
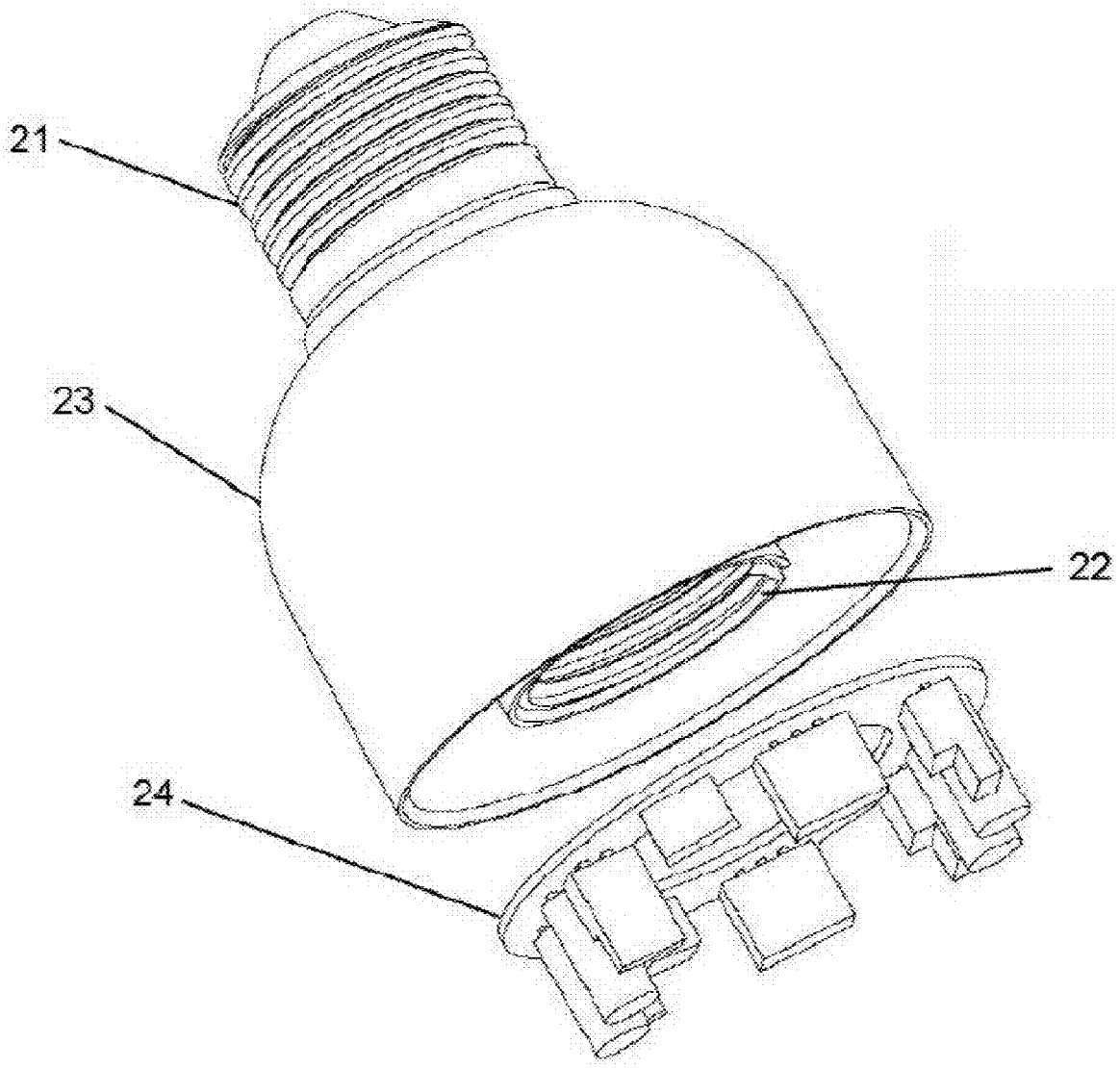
FIG. 4 schematically depicts another embodiment of the present disclosure.
Figure 5:
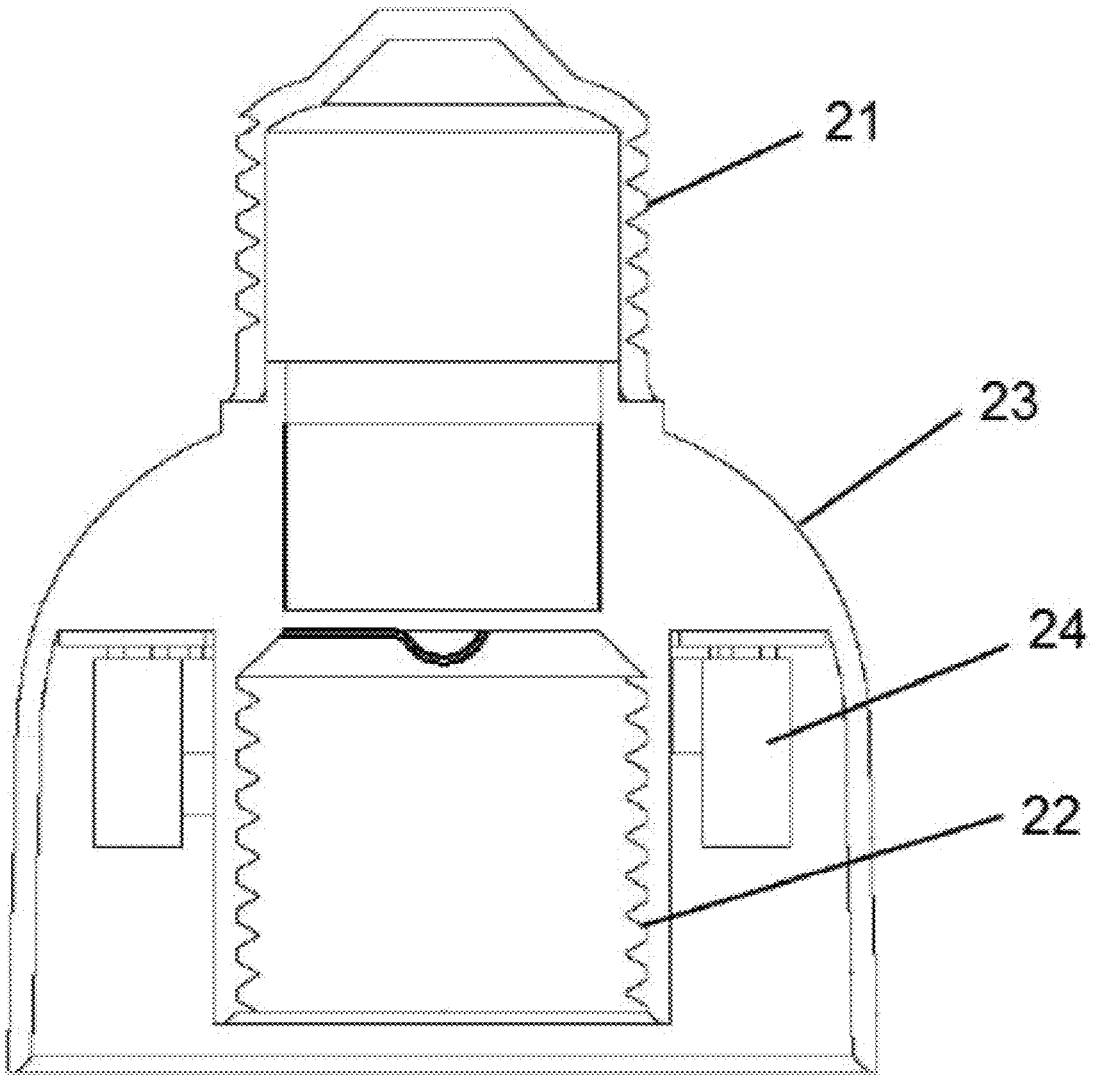
FIG. 5 schematically depicts a fourth embodiment of the present disclosure from another angle.
Figure 6:
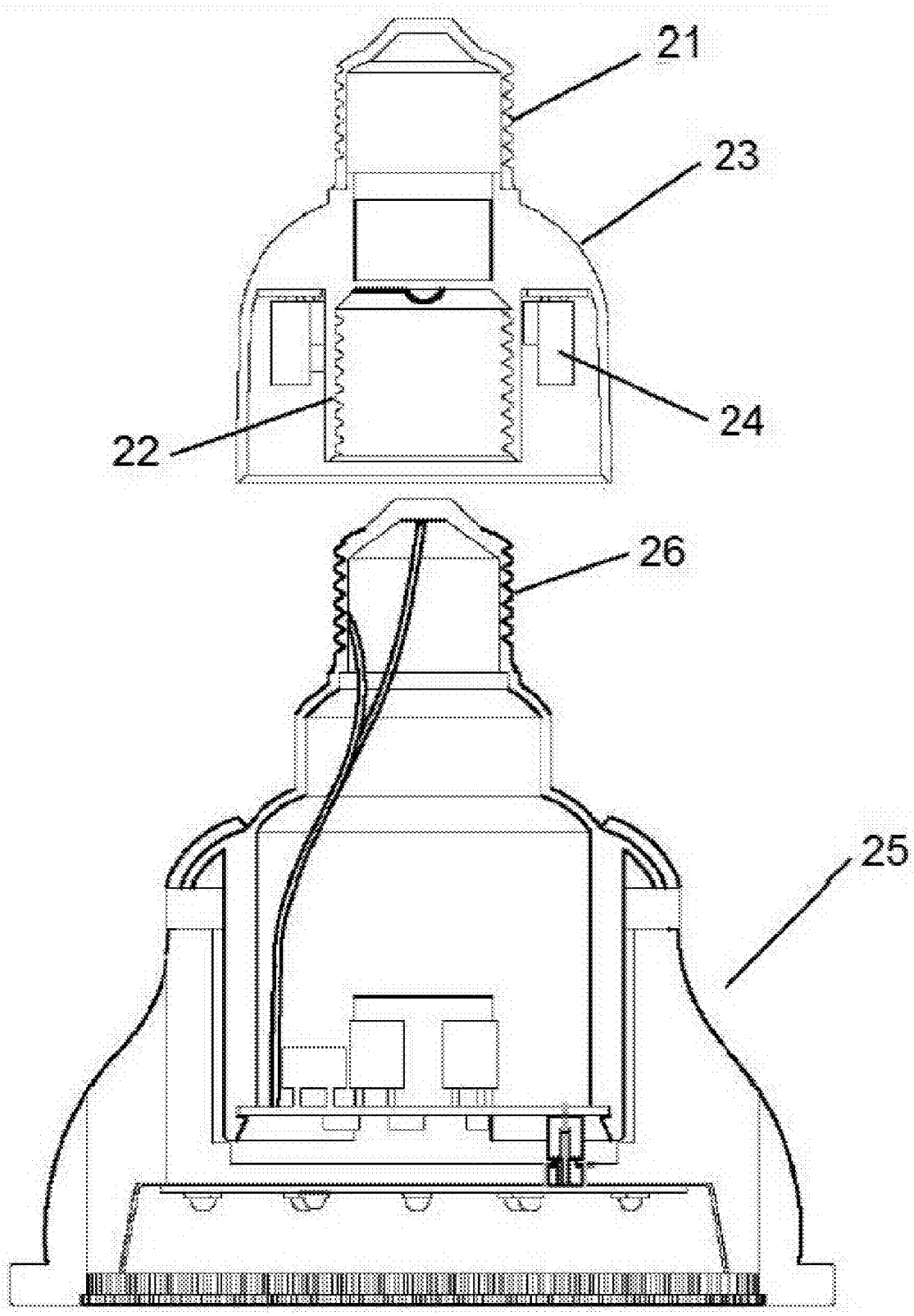
FIG. 6 schematically depicts the application of the fourth embodiment of the present disclosure.

FIGS. 4 and 5 illustrate another non-limiting embodiment of the add-on smart controller of the present disclosure in the form of an adapter that it may be attached directly to the LED lighting device. The add-on smart controller adapter comprises a power input port 21, a power output port 22, a housing 23, and a control unit 24. The control receiver is not shown in the figures for simplicity. When the control signal receiver receives an ON signal, the control unit 4 activates the output power port 22; the control signal receiver receives an OFF signal, the control unit deactivates the output power port 22. The power input port 21 takes the form of a screw-in head that may be screwed into a standard screw-in socket. The power output port 22 takes the form of a screw-in socket so that any LED lighting device with a screw-in head may be screwed into the add-on smart controller adapter. FIG. 6 illustrates the application of the add-on smart controller adapter and an LED lighting device 25 with a screw-in head 26.

The power input port 21 may take the form of any screw-in shaped connector (such as E-base), pin-shaped connector (such as MR-base, GU-base, PL-base), or any existing standard electrical connector. Similarly, the power output port 22 may take the form of any screw-in shaped socket, hole-shaped socket, or any existing standard electrical sockets. Alternatively, the shape of the power input port 21 may or may not match the shape of the power output port 22. Alternatively, the housing 23 may include a concavity to house the socket of the power output port 22.

In some embodiments, the connecting mechanism between the controller and the LED lighting device comprises the power output port which takes the form of any screw-in shaped socket, hole-shaped socket, or any existing standard electrical socket. Similarly, in some embodiments, the power input port may take the form of any screw-in shaped connector, pin-shaped connector, or any existing standard electrical connector. Moreover, in some embodiments, the shape of the power input port may or may not match the shape of the power output port.

Additional and Alternative Implementation Notes

Although the techniques have been described in language specific to certain applications, it is to be understood that the appended claims are not necessarily limited to the specific features or applications described herein. Rather, the specific features and examples are disclosed as non-limiting exemplary forms of implementing such techniques.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

For the purposes of this disclosure and the claims that follow, the terms "coupled" and "connected" may have been used to describe how various elements interface. Such described interfacing of various elements may be either direct or indirect.

What is claimed is:

1. An add-on smart controller for an LED lighting device, comprising:
- a power input port;
- a power output port;
- a housing;
- a control unit in the housing; and
- at least one control signal receiver in the control unit,
- wherein:
  - a power input of the control unit is connected to the power input port,
  - a power output of the control unit is connected to the power output port,
  - the control signal receiver is configured to receive external control signals,
  - the control unit is configured to activate the power output port to supply output voltage responsive to the control unit receiving an ON signal, and
  - the control unit is configured to deactivate the power output port responsive to the control unit receiving an OFF signal.

2. The add-on smart controller of claim 1, wherein the control unit includes a dimmer configured to control the output voltage or current flowing through the power output port according to the control signal.

3. The add-on smart controller of claim 2, wherein the dimmer is a voltage-based step-dimmer and configured to control the output voltage of the power output port according to the control signal.

4. The add-on smart controller of claim 3, wherein the voltage-based step-dimmer comprises a control signal input port, a controllable switcher, and a transformer, wherein the control signal input port is connected to the controllable switcher, wherein an output of the controllable switcher is connected to an input of the transformer, and wherein an output of the transformer is connected to the power output port.

5. The add-on smart controller of claim 4, wherein the voltage-based step-dimmer is configured to supply power at a voltage level same as an external input power, at a voltage level lower than the external input power, or at zero voltage.

6. The add-on smart controller of claim 2, wherein the dimmer is a voltage-based linear dimmer comprising a control signal input port, a step-motor, and an autotransformer, where the control input signal is connected to and configured to control the step-motor, wherein the step-motor is configured to control an input level of the autotransformer and cause an output level of the autotransformer to change in a linear fashion.

7. The add-on smart controller of claim 2, wherein the dimmer is a current-based linear dimmer configured to control the effective operation cycle of an AC input current wave from 360 degrees down to 0 degree in a linear or step-wise fashion according to the control signal.

8. The add-on smart controller of claim 1, wherein the control signal receiver is configured to receive control signals through infra-red signals, WiFi signals, Bluetooth signals, power-line-transmitted signals, a control signal line, or a combination thereof.

9. The add-on smart controller of claim 1, wherein the control signal receiver includes an Internet network interface configured to receive control signals according to IP protocol.

10. The add-on smart controller of claim 1, wherein the control unit includes a motion sensor configured to activate the power output port using motion detection.

11. The add-on smart controller of claim 1, wherein the control unit includes a sound sensor configured to activate the power output port using sound detection.

12. The add-on smart controller of claim 1, wherein the control unit includes a color tuning module configured to adjust a color temperature of the LED lighting device.

13. The add-on smart controller of claim 1, wherein the control unit includes an ambient light sensor configured to control the dimmer automatically according to an ambient light level.

14. The add-on smart controller of claim 1, wherein the control unit includes a rectifier configured to convert an AC input current to a DC output current.

15. The add-on smart controller of claim 1, wherein the controller includes a connecting mechanism that attaches the controller directly onto the LED lighting device.

16. The add-on smart controller of claim 14, wherein the connecting mechanism, disposed between the controller and the LED lighting device, comprises the power output port comprising any screw-in shaped socket, hole-shaped socket, or any existing standard electrical socket.

17. The add-on smart controller of claim 14, wherein the power input port comprises any screw-in shaped connector, pin-shaped connector, or any existing standard electrical connector.

18. The add-on smart controller of claim 15, wherein a shape of the power input port matches a shape of the power output port.

19. The add-on smart controller of claim 15, wherein a shape of the power input port does not match a shape of the power output port.

20. The add-on smart controller of claims 16, wherein the housing includes a concavity to house the socket of the power output port.

21. The add-on smart controller of claim 2, wherein the control unit includes an ambient light sensor configured to control the dimmer automatically according to an ambient light level.

* * * * *